US005283984A

United States Patent [19]

Gilman

[11] Patent Number: 5,283,984

[45] Date of Patent: Feb. 8, 1994

[54] LENS AXIS ALIGNMENT DEVICE FOR USE IN A LENS-SURFACING MACHINE

[75] Inventor: Donald L. Gilman, Cincinnati, Ohio

[73] Assignee: Lyric Optical Company, Inc., Cincinnati, Ohio

[21] Appl. No.: 76,484

[22] Filed: Jun. 14, 1993

Related U.S. Application Data

[63] Continuation of Ser. No. 774,558, Oct. 10, 1991, abandoned.

[51] Int. Cl.[5] ..... B24B 41/06; B24B 7/00

[52] U.S. Cl. ..... 51/216 LP; 51/216 R; 51/217 L; 51/277; 51/125

[58] Field of Search ..... 51/216 LP, 216 R, 217 L, 51/234, 284 R, 46, 277, 58, 65, 124 L, 124 R, 126, 166 R, 170 R, 216 P, 125

[56] References Cited

U.S. PATENT DOCUMENTS

| | | | |
|---|---|---|---|
| 1,292,926 | 1/1919 | Troppman | 51/124 L |
| 2,087,687 | 7/1937 | Houchin | 51/217 L |
| 3,383,808 | 5/1968 | Deshayes | 51/277 |
| 3,449,198 | 6/1969 | Spragg | 51/234 |
| 3,501,842 | 3/1970 | Beasley | 51/277 |
| 3,522,677 | 8/1970 | McCall | 51/284 |
| 3,830,021 | 8/1974 | Blum | 51/216 LP |
| 4,158,273 | 6/1979 | Olsen | 51/216 LP |
| 4,341,045 | 7/1982 | Sorrells | 51/277 |
| 4,653,234 | 3/1987 | Lombard | 51/216 LP |
| 4,686,798 | 8/1987 | Petty | 51/217 L |

*Primary Examiner*—Bruce M. Kisliuk
*Assistant Examiner*—Bo Bounkong
*Attorney, Agent, or Firm*—Wood, Herron & Evans

[57] ABSTRACT

A lens axis alignment device is provided for use in a lens-surfacing machine. The device has a lens carrier for a blocked lens and means for locking the blocked lens on the carrier. The lens axis alignment means is provided to align the blocked lens axis with respect to the carrier. The invention enables optical retail stores to provide 1-hour service for multifocal lenses using only one machine at the retail point.

10 Claims, 1 Drawing Sheet

LENS AXIS ALIGNMENT DEVICE FOR USE IN A LENS-SURFACING MACHINE

This application is a continuation of application Ser. No. 07/774,558, filed Oct. 10, 1991, abandoned.

FIELD OF THE INVENTION

This invention relates to a lens axis alignment device for use in a lens-surfacing machine, so as to permit optical retail stores to provide a 1-hour service for multifocal lenses, the lenses being specially surfaced using only one machine at the retail point.

BACKGROUND OF THE INVENTION

Speedy service is becoming the norm for many consumer products such as spectacles or optical lenses. To meet this demand, optical retail stores glaze and fit stock lenses into frames and advertise a 1-hour service. But the provision of multifocal or varifocal lenses presents difficulties. Approximately 80% of multifocal patients need a cylinder correction, and until recently there was no alternative to sending the prescription away to an optical laboratory for processing. A quick look at the existing options for speedy service in retail practice lens-making reveals the need for a high level of investment, either in cash or in experienced personnel, to be sure of quality lenses in the short time cycles desirable.

One solution has been for an optical practice to buy thin lens wafers and then assemble two such wafers together to provide a bi-focal lens according to the prescription. The wafers are bonded with UV sensitive adhesive and cured. Although relatively fast, this method ties the practice to a narrow range of lens forms obtained only from the original supplier. Another solution is to buy equipment which permits cast lenses to be made as they would be cast in a factory. However, curing such lenses takes at least three hours by water or overnight by air, and an inevitable proportion of rejects will leave some customers still disappointed. Moreover, the equipment requires an investment of about $70,000.

The most popular option at the present time, due to the sophisticated machine tools produced by several specialist optical engineering companies and a pool of skilled labor available from existing optical wholesalers, is to use traditional lens-surfacing machines and methods. However, a thousand square feet of floor space, ample power points, water supplies with good drainage and ideally three staff members makes for a major project. An investment of nearly $100,000 is called for by this option.

SUMMARY OF THE INVENTION

The present invention constitutes an entirely new approach to traditional lens surfacing. In accordance with this invention, multifocal lenses are blocked and generated in the factory or laboratory, leaving only a lens axis alignment device and a single surfacing machine with a set of tools to be installed at the retail store. Thus, only a small working area, without the need for skilled staff is required and the investment can be as low as $15,000–20,000 at current prices.

The present invention in one of its aspects is directed to a lens axis alignment device comprising a lens carrier adapted to support a blocked lens and having locking means for removably locking the blocked lens on the carrier. A lens axis alignment means for alignment of said blocked lens axis with respect to the carrier is provided. The blocked lens is pivotally mountable on the carrier and alignment is achieved by pivotal movement of the blocked lens axis with respect to the carrier. The carrier also has means for supporting it on a lens-surfacing machine.

In other more preferred features of the invention, the lens axis alignment device is in the form of a yolk comprising a central portion having a depression adapted to receive the blocked lens with two arms projecting on opposite sides of the central portion for supporting it on a lens-surfacing machine. Pivot sockets are provided in the outer end portions of the arms to receive and accurately locate the lens carrier with respect to locating means on the lens-surfacing machine.

In its most preferred form, the lens axis alignment device has a circular carrier with a protractor scale directly mounted thereon so that the blocked lens is pivotally and removably mountable for alignment directly by the carrier scale.

In another feature of this invention, the lens axis alignment device is adapted for operation with a lens-surfacing machine which incorporates the device as a removable component. The lens-surfacing machine has a pneumatically-loaded arm provided with locating pins which are adapted to locate in sockets provided in the lens axis alignment device. The machine is provided with a grinding element for grinding a desired contour on a blocked lens mounted by the lens axis device on the machine. The lens-surfacing machine has a pneumatically-loaded arm that is arranged for reciprocating movement and the grinding element is arranged for oscillating random movement. These lens-surfacing or grinding machines are known, but have not been used in a manner, or with the lens axis alignment device, provided by this invention.

Incorporated herein by reference is application Ser. No. 401,915 in the name of Stephen Jack Wylde, filed Sep. 1, 1989 for Lens Location Block, now U.S. Pat. No. 5,114,221. That application describes a blocked lens that is particularly adapted for use with the lens axis alignment device of this invention. In other words, the lens is already "blocked" with a molded part for carrying the lens, and the 0° respect to the segment or varifocal area, prior to the lens being applied to the lens axis alignment device of this invention at the retail store. Thus, blocking and marking of the lens is carried out at the factory or laboratory and not at the retail store. Accordingly, the invention provides a retail practitioner with necessary means to make lenses at a minimum capital cost. This arises out of the fact that semi-finished multifocal lens plastic or glass blanks are blocked onto an inexpensive disposable lens blocked in the factory, whereafter the mounted lenses are machined to a spherical curve and correctly decentered in relation to a reading segment or varifocal area. The blocked lenses are of correct thickness to allow for cylindrical lapping at a retail store. The blocked lenses supplied by a factory are stocked at the retail store to await the toric prescription. The prescribed lens is then aligned for the prescription axis in the device according to this invention, after which the device with the blocked lenses is mounted in the lens-surfacing machine. These and other advantages will be appreciated with reference to the drawings and detailed description as follows.

DETAILED DESCRIPTION AND DRAWINGS

A lens axis alignment device and a lens-surfacing machine schematic are shown in the accompanying drawings in which.

Figure 1:
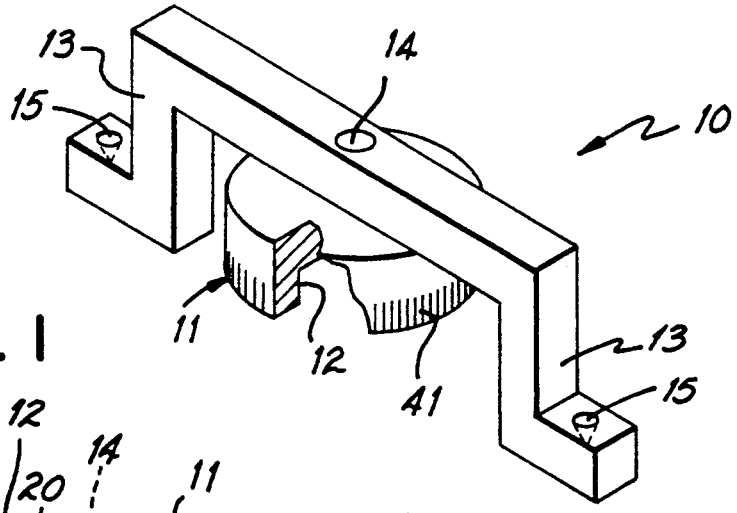
FIG. 1 is a part-sectional perspective view of a lens axis alignment device in accordance with the invention.

The lens axis alignment device will be described first with reference to FIGS. 1-2 of the drawings. The lens axis alignment device shown generally at 10 is in the form of a yolk in that it comprises a central circular carrier 11 having a depression 12 adapted to receive a blocked lens 26. The carrier 11 has two radially projecting arms 13 on its opposite sides. The depression 12 serves to receive, and to act as a pivotal mounting for, a blocked lens 26 carried by the device 10. As indicated above, the blocked lens is preferably made in accordance with the application Ser. No. 401,951, now U.S. Pat. No. 5,114,221 and the entirety of the description therein is incorporated herein by reference.

Figure 2:
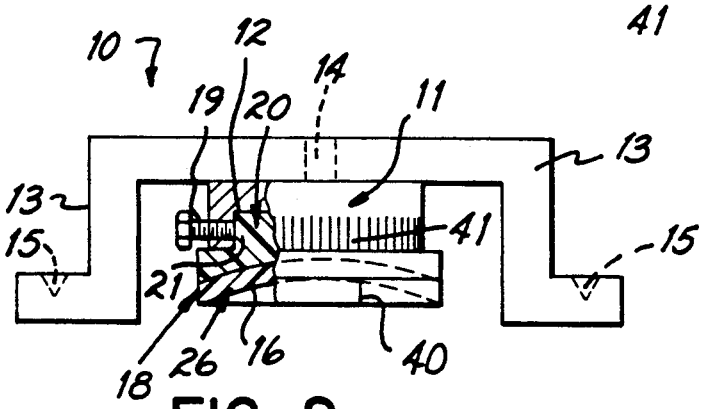
FIG. 2 is a part-sectional side view of the device of FIG. 1 having the blocked lens pivotally and removably mounted thereon.

As will be seen from FIGS. 1-2, the carrier 11 has pivot sockets 15 in the outer end portions of the arms 13 to receive locating means on a lens-surfacing machine for grinding and polishing the lens, as well as locating the device 10 accurately on the machine. Also, a central aperture 14 in depression 12 is aligned with pivot sockets 15 for checking the thickness of the lens during the grinding operation by simply removing the device 10 having the blocked lens mounted thereon. The lens axis alignment device 10 is used to align a lens axis in the manner illustrated in FIGS. 2-3 where the portion 21 of the blocked lens 26 has been received in the depression 12 of the carrier 11. As will be seen from FIG. 2, the actual lens 18, made of glass or plastic, is carried on a lens block 20 made of a synthetic plastics material which has been molded. It is the portion 21 of reduced cross-section on the block 20 which is actually received in the depression 12 of carrier 11.

Figure 3:
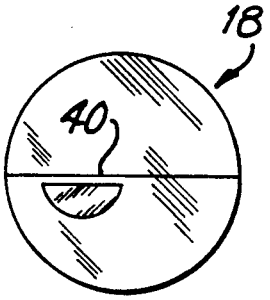
FIG. 3 is a plan view from below of the blocked lens showing the factory markings on its surface.

Prior to the lens being blocked in the factory, the desired zero axis for the lens is marked either on the lens, or the block for the lens, or on a clear plastic film applied to the convex surface of the lens so that the zero axis can b seen clearly as shown in FIG. 3. Once, therefore, the blocked lens 26 has been mounted on the device 10, the blocked lens 26 is then rotated on the carrier 11 until the axis line 40 on the lens (see FIG. 3) is aligned with the appropriate degree marking (0°-180° scale) of the protractor arc 41 device 10 (see FIG. 2). The blocked lens is then locked against rotation on the carrier 11 by rotation of a locking screw 19 which bears against the larger-section portion of the block 20. The device 10 and the blocked lens 26 thereon can now be placed in a lens-surfacing machine which is also present at the point of retail sale, the machine having pins or other means which are located in the pivot sockets 15 of arms 13.

Figure 4:
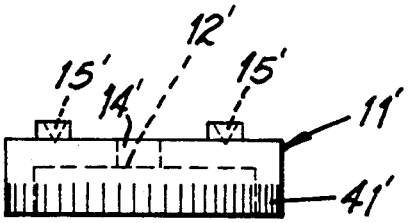
FIG. 4 is a side view of an alternate embodiment of the device shown in FIG. 1.

FIG. 4 illustrates another form of the device where the arms 13 of FIG. 1 device are eliminated and the circular carrier 11 is provided with pivot sockets 15' through the center axis of the carrier 11' to locate it on the surfacing machine. Otherwise, this form of the device functions in the same manner as the device of FIG. 1.

Figure 5:
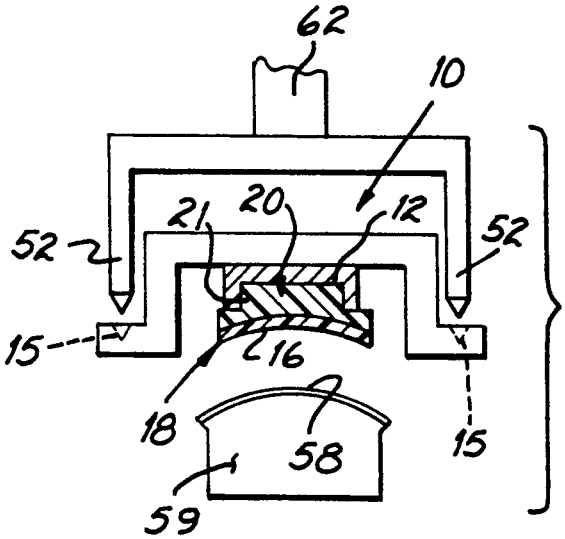
FIG. 5 is a fragmentary schematic view of a lens-surfacing machine illustrating the way in which the device and blocked lens of FIGS. 1-3 are mounted on the machine.

The actual construction of the lens-surfacing machine can vary a great deal in practice, but in accordance with the invention the lens device 10 carrying the blocked lens 26 is adapted to be mounted as a removable component on the machine so as to be driven by the latter during the lens-surfacing operation. FIG. 5 illustrates a suitable form of machine for this purpose. FIG. 5 shows the lens device 10 arranged on the machine in such a way that locating pins 52 on a pneumatically-loaded arm 62 are able to enter the pivot sockets 15 in the arms 13 of the lens axis alignment device 10. The lower concave surface 16 of the lens 18 is now brought into contact, by downward movement of the arm 62 with a diamond-coated pad 58 mounted on a toric grinding element 59 which has an oscillating random motion to grind the surface 16 of the lens to the correct contour. As the surface speed is in excess of 5,000 feet per minute, this operation normally requires only about 60 seconds.

The prescription may be checked by removing the device 10 from the machine and using the central aperture 14 to check the contour of the lens while it is mounted on the device 10 during the grinding operation. This is done by placing a pin through the aperture 14, at the center focal point of the lens 16, and checking the lens thickness with a known thickness gauge. At this stage of the operation, a friction held fine lapping and/or polishing medium is introduced between the lens and the diamond-coated pad 58 mounted on grinding element 59, thereby completing the surfacing of the lens.

It will therefore be seen that the invention provides a retail practitioner with the necessary means to make lenses at a minimum capital cost. This arises out of the fact that semi-finished multifocal lens blanks are blocked onto an inexpensive disposable lens blocked in the factory, whereafter the mounted lenses are machined to a spherical curve and correctly decentered in relation to a reading segment or varifocal area, the lenses being of correct thickness to allow for cylindrical lapping at a retail store. The blocked lenses supplied by a factory are stocked at the retail store to await the toric prescription. The prescribed lens is then aligned for the prescription axis in the device shown in the drawings of the present application, after which the device 10 with the blocked lens 26 thereon is mounted in a lens-surfacing machine as shown in FIG. 6 which uses diamond pads, abrasive pads and plain water for the machining and polishing operation. The finished lens is then snapped out of the block 20 which can be discarded thereby leaving only checking and edging of the lenses before sale.

Having described this invention in its best mode of operation, other forms and embodiments will become apparent to a person of ordinary skill in the art, and such are within the scope of this invention.

What is claimed is:

1. A lens axis alignment device comprising a lens carrier for a blocked lens having locking means for locking the blocked lens on the carrier, said blocked lens having a zero axis, a lens axis alignment means having an arcuate scale directly on said carrier for alignment of said blocked lens axis with respect to said carrier, said carrier for supporting said blocked lens for alignment by said alignment means by pivotally moving said blocked lens axis with respect to the carrier to align said blocked lens axis with said scale, said carrier comprising a central portion having a depression adapted to receive the blocked lens for supporting said lens on a lens-surfacing machine, said carrier having two pivot sockets along a carrier longitudinal axis for receiving locating means on said lens-surfacing machine, a central aperture is received through the center of said carrier depression between said two pivot sockets for checking a thickness of the blocked lens during lens grinding by said lens-surfacing machine, said carrier central aperture is aligned with said pivot sockets along the carrier longitudinal axis.

2. A lens axis alignment device of claim 1 which is the form of a yoke having said central portion adapted to receive said blocked lens with two arms projecting on opposite sides of said central portion for supporting said carrier on a lens-surfacing machine in which pivot sockets are provided in the outer end portions of each arm to receive said locating means on lens-surfacing machine.

3. A lens axis alignment device of claim 1 wherein said carrier ha a protractor scale directly thereon for alignment of said blocked lens axis.

4. The lens axis alignment device of claim 3 in which said carrier ha a protractor scale in an arc about the central portion surrounding said depression for alignment of said blocked lens axis.

5. The lens axis alignment device of claim 1 wherein the locking means comprises a locking element which engages a peripheral surface of the blocked lens.

6. The lens axis alignment device of claim 5 wherein the locking element comprises a screw.

7. A lens-surfacing machine having means for grinding or polishing a lens and which incorporates, as a removable component, a lens axis alignment device as claimed in claim 1.

8. A lens-surfacing machine according to claim 7 having an arm provided with said locating means adapted to removably located said lens axis alignment device.

9. The lens axis surfacing machine according to claim 7 in which the machine is provided with a toric grinding means for grinding a desired contour on a blocked lens mounted with the lens axis alignment device on the machine.

10. A lens-surfacing machine having means for grinding or polishing a lens and which incorporates, as a removable component, the lens axis alignment device of claim 1 and said machine further comprising locating means provided with locating pins adapted to locate with said carrier kinot sockets.

* * * * *